US009334611B2

(12) United States Patent
Barezzani et al.

(10) Patent No.: US 9,334,611 B2
(45) Date of Patent: May 10, 2016

(54) APPLICATOR FOR THE REMOVAL AND ATTACHMENT OF A CONTACT CLIP TO A RAIL

(71) Applicant: Cembre S.p.A., Brescia (IT)

(72) Inventors: Gualtiero Barezzani, Concesio (IT); Samuel Veglianti, Ghedi (IT)

(73) Assignee: Cembre S.p.A., Brescia (IT)

( * ) Notice: Subject to any disclaimer, the term of this patent is extended or adjusted under 35 U.S.C. 154(b) by 317 days.

(21) Appl. No.: 13/856,750

(22) Filed: Apr. 4, 2013

(65) Prior Publication Data

US 2013/0276278 A1 Oct. 24, 2013

(30) Foreign Application Priority Data

Apr. 6, 2012 (IT) ..... MI2012A0567

(51) Int. Cl.
*E01B 29/32* (2006.01)
*E01B 29/24* (2006.01)

(52) U.S. Cl.
CPC ..... *E01B 29/32* (2013.01); *E01B 29/24* (2013.01); *Y10T 29/53783* (2015.01)

(58) Field of Classification Search
CPC .... E01B 29/32; E01B 29/24; Y10T 29/53783
See application file for complete search history.

(56) References Cited

U.S. PATENT DOCUMENTS

| | | | | |
|---|---|---|---|---|
| 3,095,826 | A * | 7/1963 | Swanson | 104/17.2 |
| 3,121,400 | A * | 2/1964 | Giebel et al. | 104/17.2 |
| 4,999,898 | A * | 3/1991 | Schmeling | 29/243.56 |
| 5,161,292 | A * | 11/1992 | Kurtyak et al. | 29/243.56 |
| 5,694,856 | A * | 12/1997 | Theurer | 104/17.2 |
| 2007/0039510 | A1* | 2/2007 | Claas et al. | 104/2 |
| 2007/0157844 | A1* | 7/2007 | Barezzani et al. | 104/2 |
| 2010/0000288 | A1* | 1/2010 | Barezzani et al. | 72/453.15 |
| 2014/0182874 | A1* | 7/2014 | Barezzani et al. | 173/217 |

FOREIGN PATENT DOCUMENTS

CA 2522733 A1 * 2/2007

* cited by examiner

*Primary Examiner* — Lee D Wilson
*Assistant Examiner* — Marc Carlson
(74) *Attorney, Agent, or Firm* — Blank Rome LLP

(57) ABSTRACT

An applicator for the removal and attachment of a contact clip to a railway rail comprises an applicator body forming a clip seat to receive the contact clip, a thrust jaw suitable for engaging the clip housed in the clip seat, a contrast jaw suitable for engaging the foot of the rail, a thrust device for moving the thrust jaw towards the contrast jaw so as to push the contact clip housed in the clip seat in a thrust direction towards the contrast side, in which the clip seat is suitable for supporting the contact clip transversally to the thrust direction in an area between the thrust jaw and the contrast jaw.

19 Claims, 7 Drawing Sheets

APPLICATOR FOR THE REMOVAL AND ATTACHMENT OF A CONTACT CLIP TO A RAIL

BACKGROUND OF THE INVENTION

The present invention relates to a system for the application and removal of a contact clip to a rail, in particular to a railway rail.

To ensure the continuity of traction voltage and the transmission of signals along railway lines during maintenance or repair operations to specific sections of rail, it is often necessary to short circuit two adjacent sections of rail, that is to say, electrically connect the sections of rail upline and downline of the repair site so as to bypass it.

Such electrical connection is made by means of an electric cable the ends of which are connected to the foot of the rail, for example by means of a contact clip in steel which forms a first hook-shaped end suitable for being forced onto a free rim of the foot of the rail, and a second end with an abutment surface facing towards the first end and suitable for abutting against a free rim of the foot of the rail on the side opposite that engaged by the first end, to block the clip in an engaged position with the rail. In such position of engagement the first hook-shaped end is pushed onto the foot of the rail, scratching the surface thereof and thus making an excellent electrical contact. Given that the thickness of the foot of the rail increases from its free rim towards the core of the rail and given the shape of the contact clip, during the application of the contact clip to the foot of the rail, the hook shaped end is elastically widened generating a force of reaction which clamps the clip elastically against the foot of the rail and ensures an elastically spring-loaded contact.

Despite the reliability of the electrical connections obtained, the application of the contact clip to the foot of the rail requires considerable force and is therefore carried out with the help of violent blows of the hammer to the contact clip. Similarly, the removal of the contact clip from the rail is performed by blows of the hammer to the end of the clip opposite the hook and, given the elastic spring-loading, violent and uncontrollable jerks of the contact clip may ensue. Both the blows of the hammer and the elastic jerks of the contact clip may entail a high risk of injury and fatigue to the fitter and prejudice the precise, controlled attachment of the contact clip to the rail.

The purpose of the present invention is therefore that of providing a system, for the application of a contact clip to a railway rail, having characteristics such as to obviate the drawbacks mentioned in relation to the prior art.

SUMMARY OF THE INVENTION

The above-noted purpose is achieved by an applicator for the attachment and detachment of a contact clip and a railway rail, in which the clip forms a first hook-shaped end suitable for being forced onto a foot of the rail, and a second end with an abutment surface facing towards the first end and suitable for abutting against the free rim of the foot of the rail on a side opposite the first end, and in which the applicator comprises:

- an applicator body forming a clip seat suitable for receiving the contact clip,
- a thrust jaw connected to the applicator body and positioned on a thrust side of the clip seat, said thrust jaw being suitable for engaging the clip housed in the clip seat,

- a contrast jaw connected to the applicator body and positioned on a contrast side of the clip seat opposite the thrust side, said contrast jaw being suitable for engaging the foot of the rail,
- a thrust device connected to the applicator body and suitable for moving the thrust jaw towards the contrast jaw so as to push the contact clip housed in the clip seat in a thrust direction towards the contrast side. The applicator can be positioned in a position of use on the rail in which the clip seat facing the foot of the rail receives the contact clip and the contrast jaw engages the foot of the rail on a first side of the rail while the thrust jaw engages an end of the clip on a second side of the rail, opposite the first side. In the position of use, the movement of the thrust jaw towards the contrast jaw moves the clip in relation to the foot of the rail so as to connect them or disconnect them. The clip seat is suitable for supporting the contact clip transversally to the thrust direction in an area between the thrust jaw and the contrast jaw.

The invention permits safe and precise control of the position of the contact clip in relation to the rail and obviates the sudden movements and jerks of the clip during its application and during its removal. In addition, the invention obviates the need to apply the required force by blows of the hammer which may injure the fitter and damage the rail.

BRIEF DESCRIPTION OF THE DRAWINGS

For a clearer comprehension of the invention and to appreciate the advantages thereof, some of its embodiments will be described below, made by way of a non-limiting example, with reference to the attached figures, wherein:

In FIG. 6 also a side wall of the applicator has been removed to better illustrate the contact clip and inner parts of the applicator;

In FIG. 9 also a side wall of the applicator has been removed to better illustrate the contact clip and inner parts of the applicator;

DETAILED DESCRIPTION OF THE PREFERRED EMBODIMENTS

Figure 1:
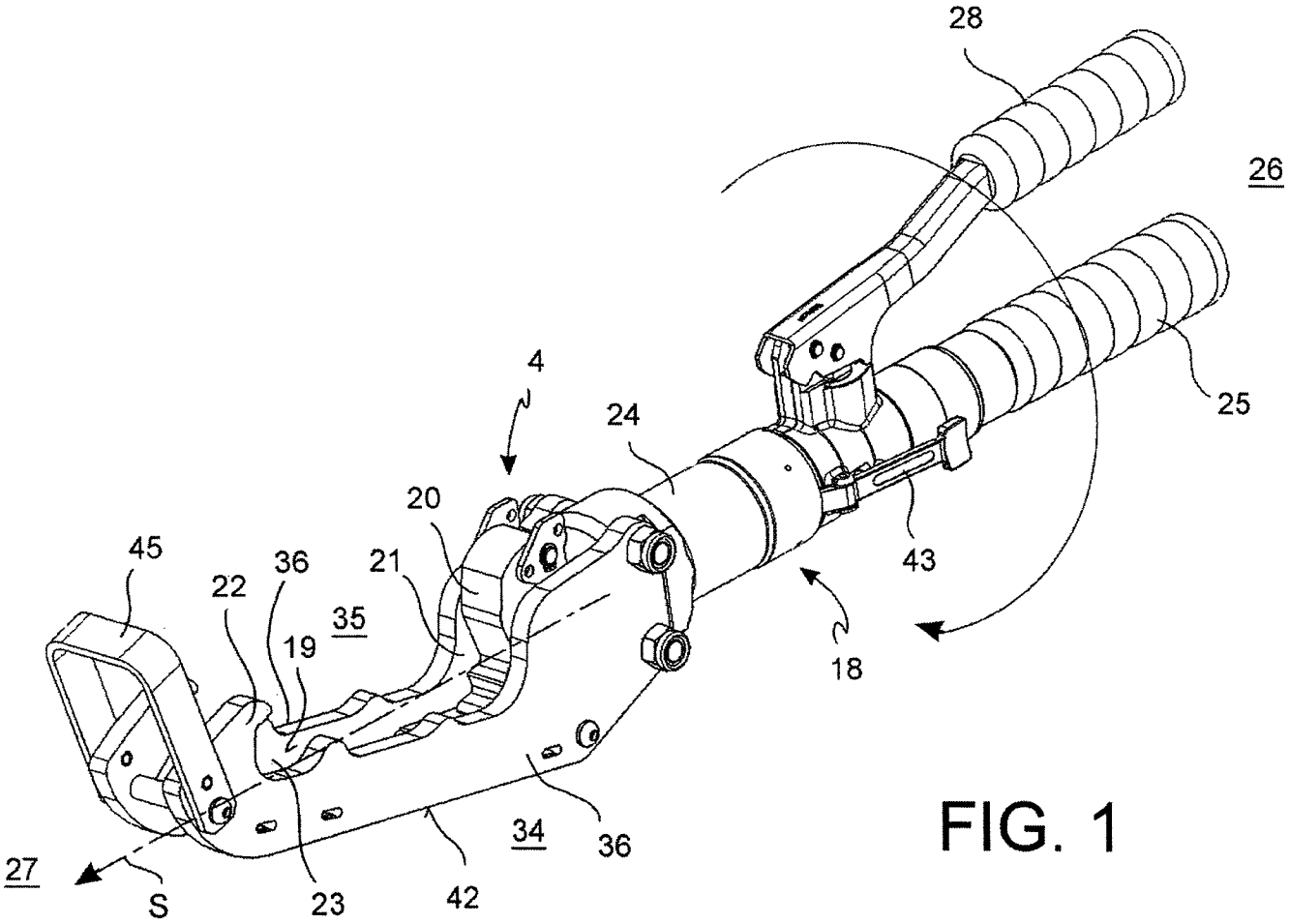
FIG. 1 shows a manual applicator for the application of a contact clip to a rail, according to an embodiment of the invention.

With reference to the figures, a system 1 for the application of a contact clip 2 to a railway rail 3 comprises a contact clip 2 in elastic metal material, in particular in steel, and a manual applicator 4.

The contact clip 2 has an elongated shape with a first hook-shaped end 5 suitable for being forced onto a free rim 6 of a foot 7 (or, in other words, lower flange) of the rail 3, and a second end 8 having at least one abutment surface 9 facing towards the first end 5 and suitable for abutting against a free rim 6' of the foot 7 of the rail 3 opposite the free rim 6 engaged by the first end 5 to block the contact clip 2 in an engaged position (FIG. 6, 8) with the rail 3.

Advantageously, the second end 8 may form a plurality of abutment surfaces 9 positioned at different distances from the first end 5 to permit the use of the same clip 2 with rails 3 of different widths.

The two ends 5, 8 of the contact clip 3 are connected to each other by a bridge portion 10 which, when the contact clip 2 stays in the engaged position, it extends under the rail 3, transversally to it, between the two opposite free rims 6, 6' of the foot 7 of the rail so that the contact clip 2 embraces the foot 7 of the rail from below.

The first hook-shaped end 5 has an end portion bent towards an upper side 11 of the clip 2 (such upper side being destined to face towards the rail) and towards the second end 8 in such a way as to form on the upper side 11 of the clip 2 a coupling seat 12 open and facing towards the second end 8 and suitable for receiving the free rim 6 of the foot 7 of the rail 3. Inside the coupling seat 12 a step may be formed with a counter-abutment surface 14 facing towards the second end 8 and against which the free rim 6 of the foot of the rail abuts in the engaged position.

Figure 3:
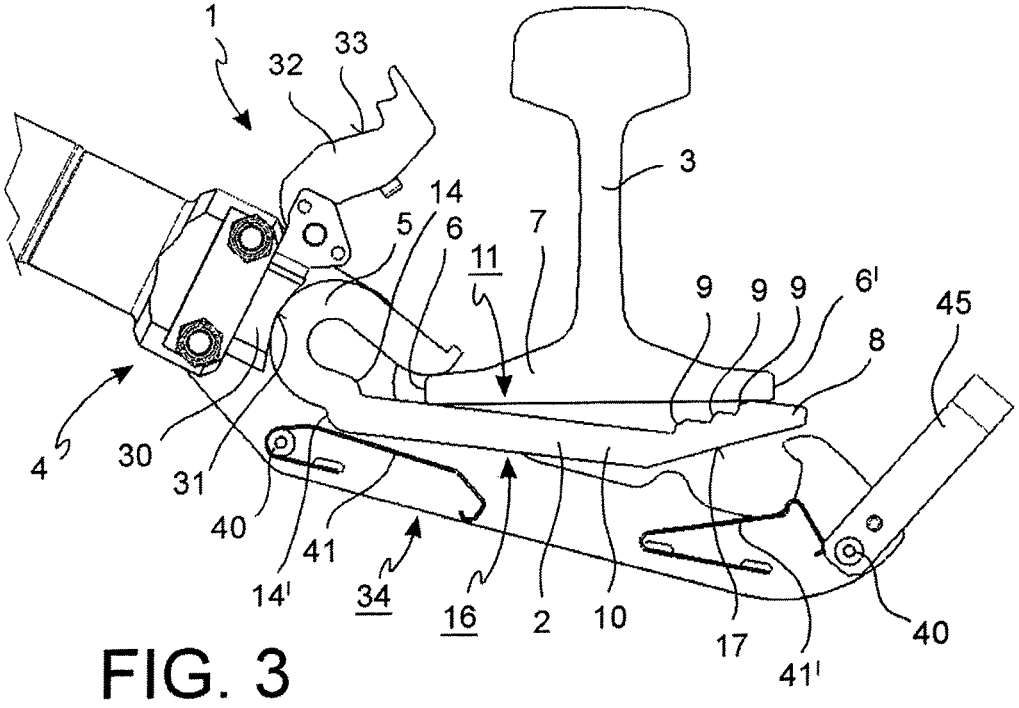
FIG. 3 shows a partial view in cross-section of the manual applicator in FIG. 1, together with a contact clip and a railway rail during an application step of the contact clip to a rail, according to an embodiment of the invention.

The first end 5 forms a free rim tapered or bent towards the upper side 11 of the clip 2 so as to give the aperture of the coupling seat 12 a funnel shape which facilitates the correct positioning and initial insertion of the clip 2 onto the foot of the rail (FIG. 3).

The second end 8 of the clip 2 may be inclined in relation to the bridge portion 10 towards the upper side 11 of the clip and may form, again on the upper side 11, a plurality of steps which form the abutment surfaces 9. On the lower side 16 of the clip 2, opposite the upper side 11, the second end 8 may form a ramp surface 17 inclined in relation to the bridge portion 10 towards the upper side 11 and suitable for acting in conjunction with a clip seat of the applicator 4 (which will be described below) to guide the abutment surface 9 in engagement with the foot of the rail. On the same lower side 16 of the clip 2, an arrest surface 14' may be formed on the counter abutment surface 14, facing towards the first hook-shaped end and useful for a correct positioning of the clip inside the clip seat of the applicator.

In one illustrative embodiment, shown in the drawings, the clip 2 forms three steps with three abutment surfaces 9 which, together with the counter-abutment surfaces 14 determine certain and clearly defined engagement positions for three different sizes of rails, such as S54, UIC54, UIC60.

The contact clip 2 may be made by forging starting from an elongated steel bar with a round transversal cross-section or by shaping starting from an elongated steel bar with a rectangular or square transversal cross-section.

The applicator 4 for the attachment and detachment between a contact clip 2 and a rail 3, in particular for a railway rail will be described below.

The contact clip 2 for which the applicator 4 has been designed is generally of the type having a first hook-shaped end 5 suitable for being forced onto a foot 7 of the rail 3, and a second end 8 with an abutment surface 9 facing towards the first end 5 and suitable for abutting against the foot 7 of the rail 3 on a side of the rail opposite that engaged by the first end 8.

More specifically, the applicator 4 has been designed for use with the contact clip 2 described above, together with which it produces synergically advantageous effects.

The applicator 4 (FIG. 1) comprises an elongated applicator body 18 which forms a clip seat 19 suitable for receiving the contact clip 2. The applicator 4 comprises, in addition, a thrust jaw 20 and a contrast jaw 22. The thrust jaw 20 is connected to the applicator body 18 and positioned on a thrust side 21 of the clip seat 19 so as to be able to engage the clip 2 housed in the clip seat 19. The contrast jaw 22, also connected to the applicator body 18, is positioned on a contrast side 23 of the clip seat 19 opposite the thrust side 21 and suitable for engaging the foot 7 of the rail 3.

The applicator 4 further comprises a thrust device 24 connected to the applicator body 18 and suitable for moving the thrust jaw 20 towards the contrast jaw 22 so as to push the contact clip 2 housed in the clip seat 19 in a thrust direction S towards the contrast side 23.

Figure 5:
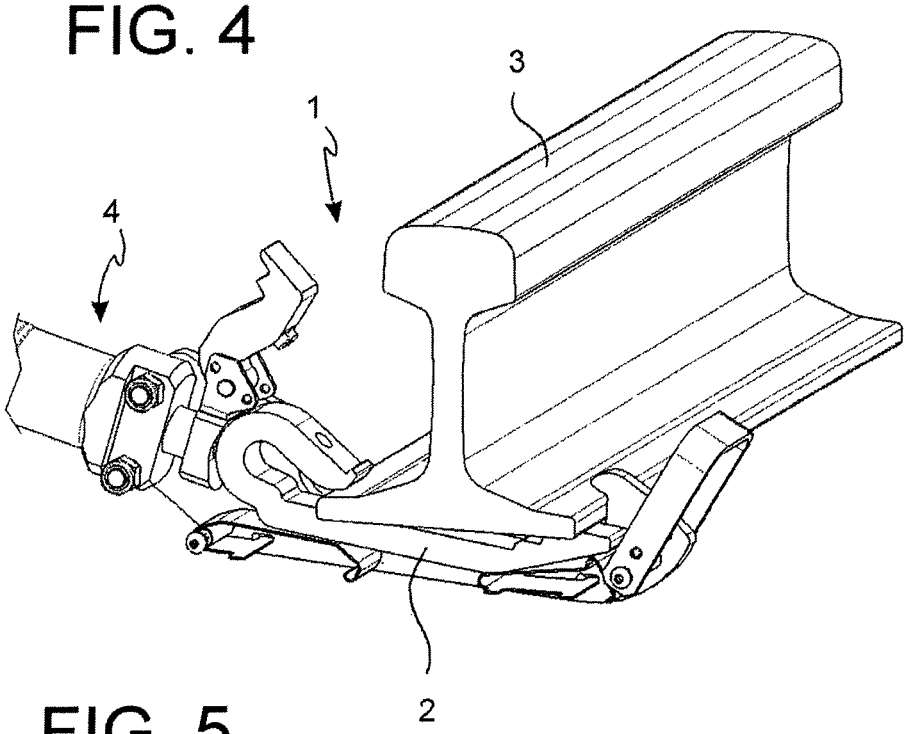
FIG. 5 is a perspective view of the situation in FIG. 4, wherein a side wall of the manual applicator is removed to better illustrate the contact clip and inner parts of the applicator.
Figure 8:
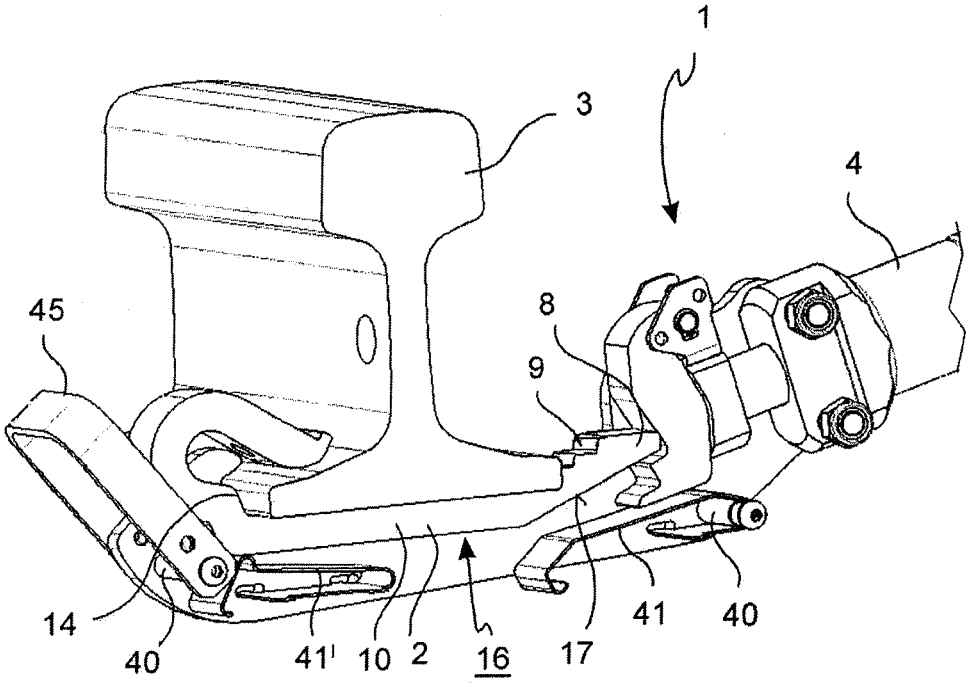
FIG. 8 is a perspective view of the situation in FIG. 7, wherein a side wall of the applicator is removed to better illustrate the contact clip and inner parts of the applicator.

As shown for example in FIGS. 5 and 8, the applicator 4 may be positioned in a position of use on the rail 3, in which the clip seat 19 is facing the foot 7 of the rail and houses the contact clip 2 and the contrast jaw 22 engages the foot 7 of the rail on a first side of the rail 3 while the thrust jaw 20 engages one end of the clip 2 from a second side of the rail opposite the first. In this position of use, the movement of the thrust jaw 20 towards the contrast jaw 22 moves the clip 2 in relation to the foot 7 of the rail so as to connect or disconnect them to one another.

According to one aspect of the invention, the clip seat 19 is configured to support the contact clip 2 transversally to the thrust direction S at least in an area between the thrust jaw 20 and the contrast jaw 22.

Thanks to the housing of the contact clip in the clip seat 19 and to the support of the contact clip 2 transversally to the thrust direction S, uncontrolled movements of the clip during the application or removal operations of the clip 2 from the foot of the rail are avoided, and perfect control of the positioning of the clip to the rail is achieved. Moreover, thanks to the thrust device 24 associated to the clip seat 19 the need to move the clip by blows of the hammer is eliminated, thus reducing the risk of injury to the fitter and the risk of damage to the rails.

According to an embodiment, the applicator body 18 has an elongated shape in the thrust direction S and forms on a rear side 26 (fitter side) a handle 25 with a grip so as to be able to grasp, transport and position the applicator 4 manually.

The clip seat 19 is formed on a front side 27 of the applicator body 18 opposite the handle 25 and the thrust device 24 may be positioned in a central portion of the applicator body 18 between the handle 25 and the clip seat 19.

According to an embodiment, the thrust device 24 is a manual thrust device, in particular a hydraulic piston cylinder unit with a pump manually operated by means of a pump lever 28 situated next to the handle 25 to enable it to be moved with one hand while the other hand grips and holds still the grip of the handle 25 at the same time providing a reaction force for the pump force applied to the pump lever 28. After an initial pumping phase needed to generate the reaction of the contrast jaw 22 the handle 25 may even be released and only the lever 28 may be operated.

Advantageously, the pump lever 28 swivels (arrow in FIG. 1) around a longitudinal axis of the applicator body 18 to permit its ergonomic and accessible positioning independently of the position of the applicator 4.

According to an alternative embodiment, the thrust device 24 may comprise a mechanical jack or electromechanical jack, such as an electric motor with a screw-nut (jackscrew) unit to convert the rotary movement of the crankshaft into a translatory movement of the thrust 2 and contrast 22 jaws.

The thrust jaw 24, and consequently, the thrust side 21 of the clip seat 19 may be provided in an area of the clip seat 19 facing towards the handle 25 or, in other words, towards the rear side 26 of the applicator 4. For example the thrust jaw 24 may be formed at a free end of a transmission stem 29 connected to the thrust device 24, in particular to a piston of the hydraulic actuator, and translatable by said thrust device 24 towards to (by manual pumping) and away from (by means of an elastic return spring) the contrast jaw 22.

According to an embodiment, the thrust jaw 20 may move, in particular translate, in relation to the clip seat 19 so as to shift the clip 2 housed in the clip seat 19 in relation to said clip seat 19 or, alternatively, the thrust jaw 20 may move together with the clip seat 19 so as to shift the clip 2 housed in the clip seat 19 in relation to the contrast jaw 22 without however moving the clip 2 in relation to the clip seat 19. In this second embodiment, the contrast jaw 22 is movable in relation to the clip seat 19.

According to the embodiment shown in the drawings, the hydraulic thrust device 24 is suitable for making the thrust jaw 20 translate inside the clip seat 19 towards the front side 27 of the applicator body 18 and the contrast jaw 22 is positioned on the front side 27 of the applicator body 18 and integral with the clip seat 19.

The clip seat 19 is suitable for housing the contact clip 2 in an application position (FIGS. 3, 4, 5, 6) in which the thrust jaw 20 engages the first hook-shaped end 5, and in a removal position in which the thrust jaw 20 engages the second end 8.

Figure 2:
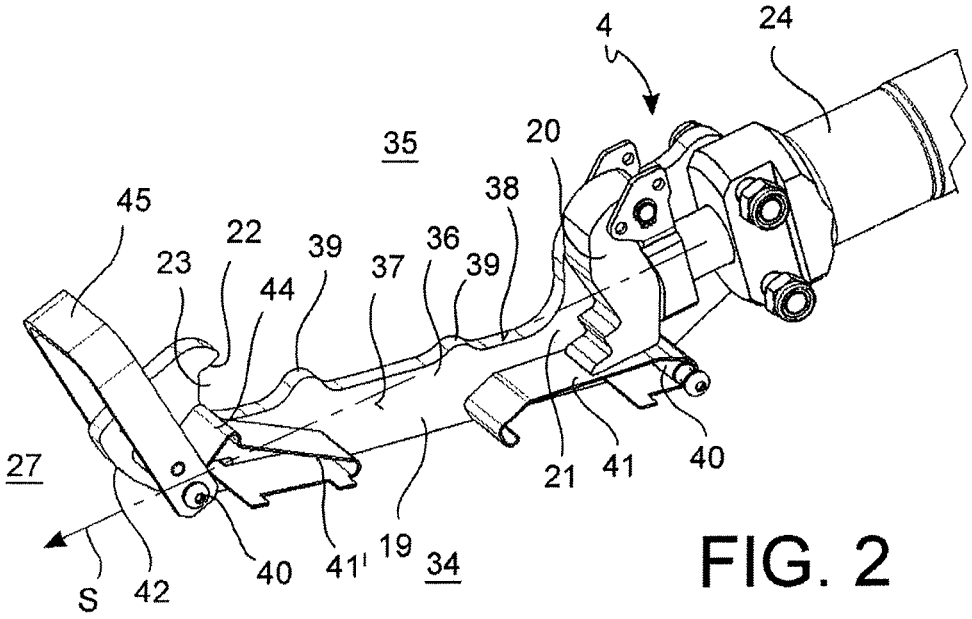
FIG. 2 illustrates the manual applicator in FIG. 1 with a side wall removed.
Figure 6:
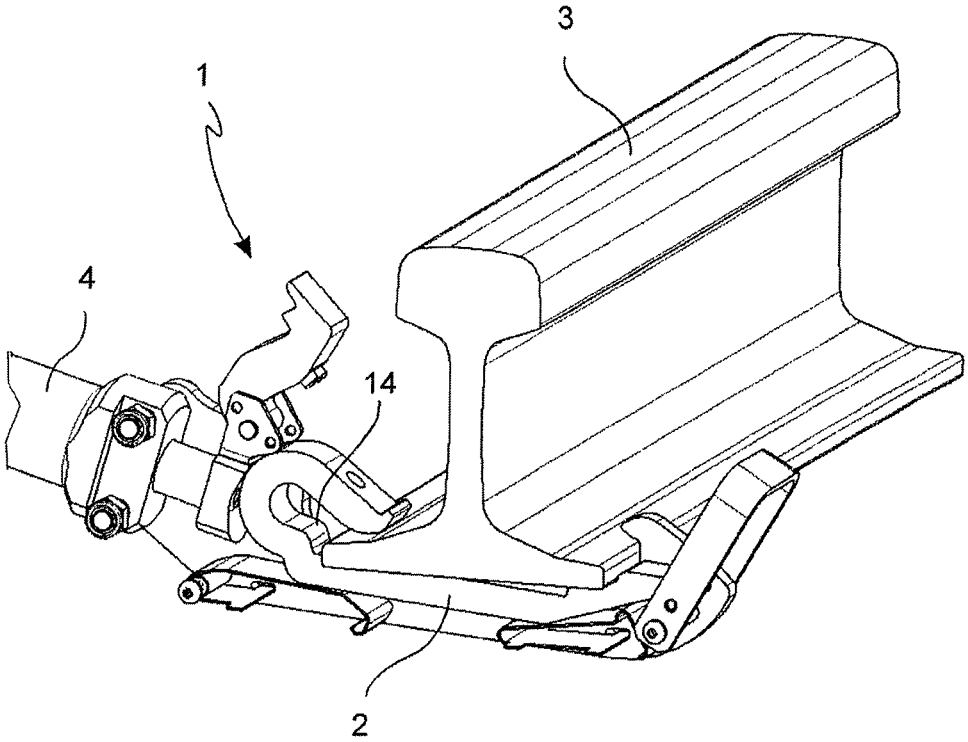
FIG. 6 is a partial perspective view of the manual applicator, of the contact clip and of the railway rail during a further application step of the contact clip to the foot of the rail.
Figure 7:
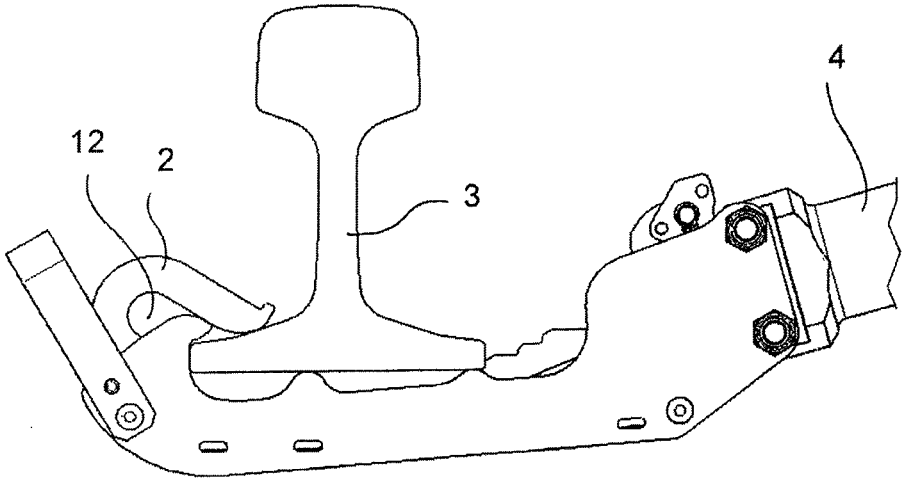
FIG. 7 shows a partial side view of the manual applicator in FIG. 1, together with a contact clip and a railway rail during a removal step of the contact clip from the foot of the rail, according to an embodiment of the invention.
Figure 9:
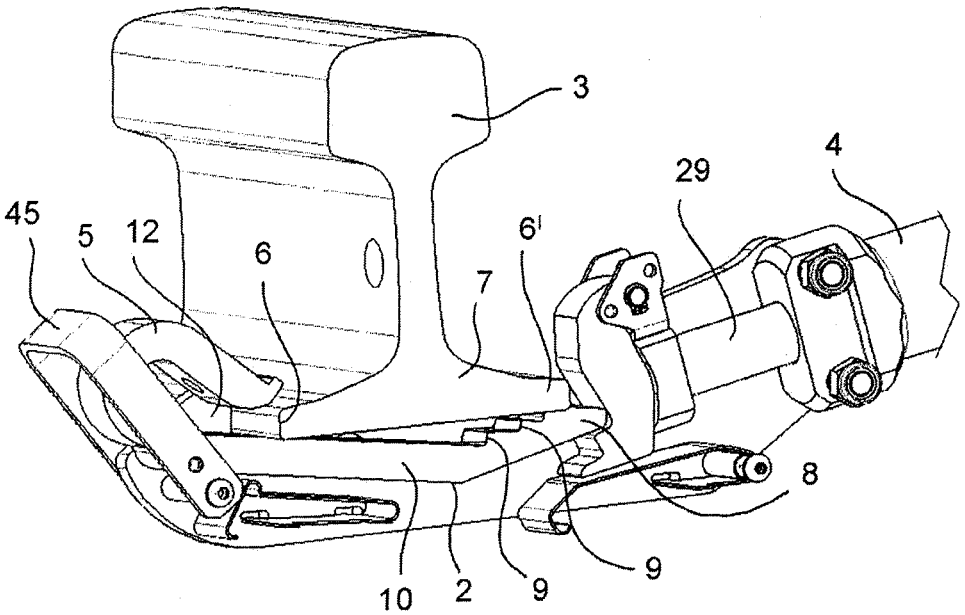
FIG. 9 is a partial perspective view of the manual applicator, of the contact clip and the railway rail during a further removal step of the contact clip from the foot of the rail.
Figure 10:
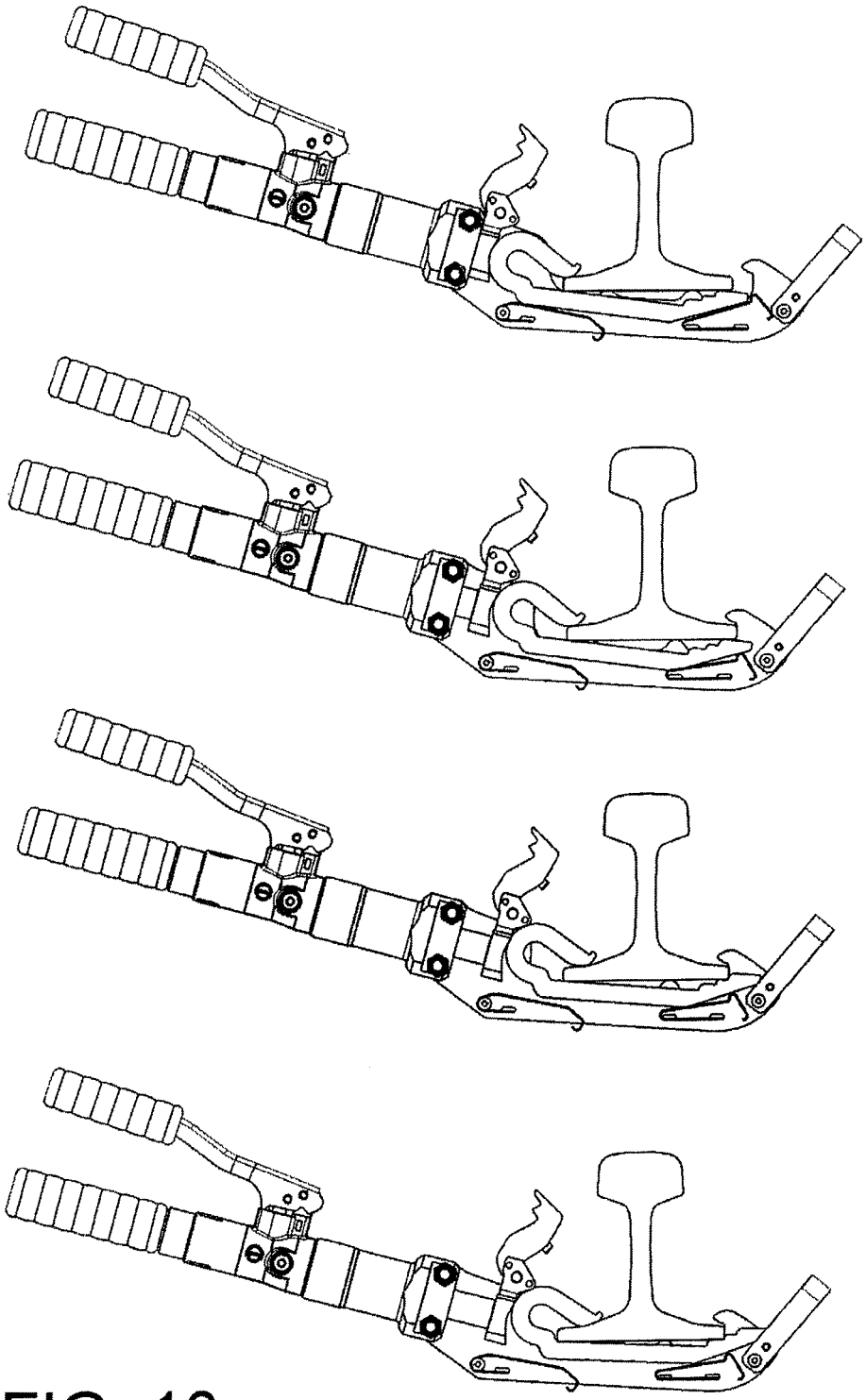
FIG. 10 shows a sequence of steps of application of a contact clip to a railway rail by means of the applicator according to an embodiment.
Figure 11:
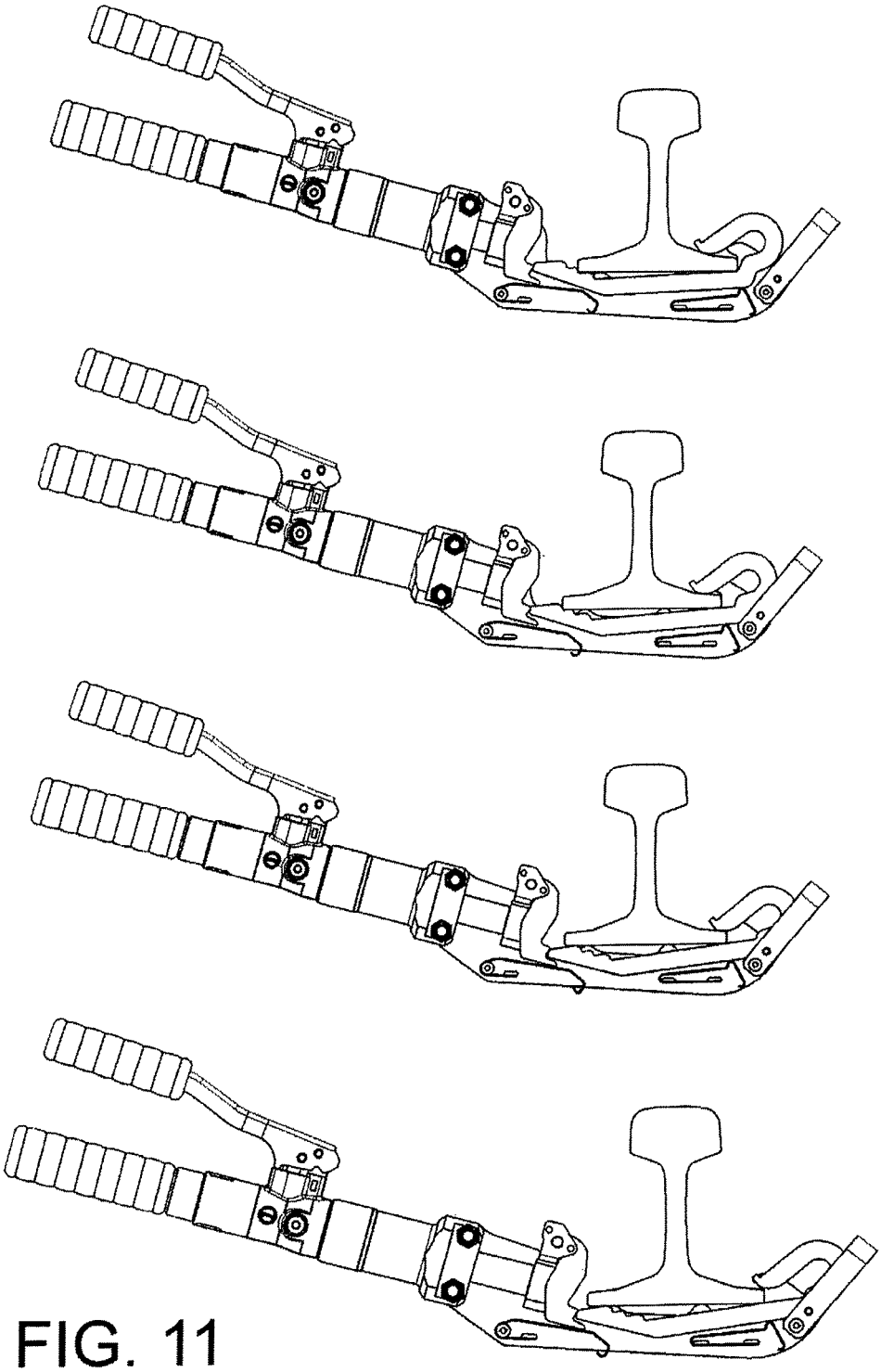
FIG. 11 shows a sequence of steps of removal of a contact clip from a railway rail by means of the applicator according to an embodiment.

In order to adapt the position and shape of the thrust jaw 20 to the different shapes of the first 5 and second 8 ends of the clip 2 and to prevent an unwanted stroke of the thrust jaw 20 towards the clip 2, the thrust jaw 20 may comprise a thrust portion 30 which forms a first thrust surface 31 (preferably concave) suitable for engaging the (outer convex surface of the) first hook-shaped end 5 of the clip 2, as well as an adaptor block 32 which forms a second thrust surface 33 suitable for engaging the second end 8 of the clip 2 and being positioned so as to compensate a part of the stroke of the thrust jaw 20. The adaptor block 32 may be connected (for example hinged) to the thrust portion 30 in a movable manner between a working position overlapped to the first thrust surface 31 (FIGS. 2,9) and a rest position away from the first thrust surface (FIGS. 3,6). The second thrust surface 33 preferably forms one or more recesses having different depths, shapes and positions to adapt to the shape and position of the second end 8 of the clip 2 to be removed from the rail (FIGS. 2,8 and 9). This makes it possible, during the removal operation of a clip 2, to press the second end 8 with the abutment surface 9 downwards, that is to say away from the free rim 6' of the foot of the rail, to uncouple the abutment surface 9 from said rim 6' before pushing the clip 2 in the thrust direction S to disengage the first hook-shaped end 5.

The contrast jaw 22 is preferably hook-shaped defining a cavity facing towards the thrust side 21 of the clip seat 19 or, in other words, towards the rear side 26 of the applicator body 18, and suitable for receiving a free rim 6, 6' of the foot 7 of the rail 3 and engaging such free rim 6, 6' from above and from the side. This makes it possible to position the applicator 4 under the rail 3, couple or hang the contrast jaw 22 (and the entire front end of the applicator 4) to the foot 7 of the rail 3 and move the clip seat 19 towards it from under the foot of the rail, rotating the applicator 4 around the fulcrum formed by the contrast jaw 22 by easily raising the handle 25 extending from the other side of the rail.

According to an embodiment, the applicator body 18 comprises two side walls 36, preferably parallel, which may be screwed to the thrust device 24 and connected to each other by bridge elements 40, made for example by means of bolts and spacer bushes. The side walls 36 form inner surfaces 37 facing each other which delimit the clip seat 19 laterally, and upper surfaces or rims 38 facing towards the upper side 35 of the applicator and defining a support seat for the foot of the rail. Both the upper rims 38 form two local protrusions 39 which determine a reference point together with the contrast jaw 22 for the correct positioning of the rail in relation to the clip 2 housed in the clip seat 19.

According to an embodiment, the contrast jaw 22 may be formed directly by said side walls 36.

The clip seat 19 may in addition have one or more bottom walls 41, 41' elastically yielding towards the lower side 34 of the applicator 4 and suitable for pressing the clip 2 (in the position of use) elastically against the foot of the rail. This facilitates the correct positioning of the applicator 4 with the clip 2 to the rail 3.

According to an embodiment, the elastic bottom walls 41, 41' are formed of at least one, preferably two, plate-shaped springs connected to at least one of the bridge elements 40 and/or fitted with lateral tongues inserted in corresponding cavities in the side walls 36.

The elastic walls 41, 41' advantageously comprise two components separate and deformable independently of one another, of which a first elastic wall 41 forms a first substantially flat support surface positioned to support a lower surface of the bridge portion 10 of the clip 2, and a second elastic wall 41' forms a second substantially flat support surface inclined in relation to the first support surface, wherein the second support surface is positioned to support the ramp surface of the clip 2 housed in the clip seat 19. This way the first and second support surfaces of the elastic walls 41, 41' can support the lower side of the clip 2 with substantial complementarity of shape (when the clip is in the application position).

Advantageously, the bottom elastic walls 41, 41' are formed in such a way as to guide the contact clip in the thrust direction and upwards (upper side 35 of the applicator 4), while the side walls 36 ensure a lateral support, transversally to the thrust direction S, of the clip 2. This way, the clip seat 19 can support and guide the clip 2 from below and from the two lateral sides, while in the position of use the foot of the rail covers the clip seat 19 partially from above so that the clip is perfectly guided and positioned during its movement in the thrust direction S. Moreover, the clip seat 19 is configured in such a way that the first hook-shaped end 5 of the clip 2 extends outside the upper rims 38 of the side walls 36 so as to be able to receive the free rim 6 the foot 7 of the rail 3 resting on said upper rims 38.

Advantageously, on the contrast side 23 of the clip seat 19 an elastic abutment 44 is formed positioned opposite the thrust jaw 20 and suitable for forming an abutment for the second end 8 of the clip 2 housed in the clip seat 19, so that the clip 2 can be elastically clamped between the thrust jaw 20 and the elastic abutment 44 to ensure and preserve the correct positioning of the clip 2 in the clip seat 19 during the insertion of the applicator 4 between the rail 3 and the track bed. The subsequent movement of the clip 2 in the thrust direction S moves the elastic abutment 44 disengaging it from the second end 8 of the clip. Advantageously, the elastic abutment 44 is formed by a projection of one of the elastic walls 41, 41'.

In a further embodiment, the side walls 36 form a lower rim 42 facing towards the lower side 34 of the applicator 4 and having the shape of the blade of an ice-skate, that is to say with a substantially straight central section and a front section curved towards the upper side and preferably converging in a front tip. This facilitates the insertion of the applicator 4 between the rail 3 and the track bed.

According to an embodiment, the applicator 4 further comprises an anti-expulsion bracket 45 connected to the applicator body 18 and suitable for positioning on the contrast side 23 of the clip seat 19 in an expulsion path of the clip 2 so as to prevent an uncontrolled elastic jerk expulsion of the clip from the clip seat 19 in the direction of the contrast side 23. Advantageously, the anti-expulsion bracket 45 has an arched or U-shape which extends to straddle the clip seat 19 and is movable or rotatable from the position in which it obstructs an expulsion of the clip 2 to a position in which it frees the expulsion path of the clip.

The functioning and use of the applicator 4 according to embodiments of the invention will be described below.

Figure 4:
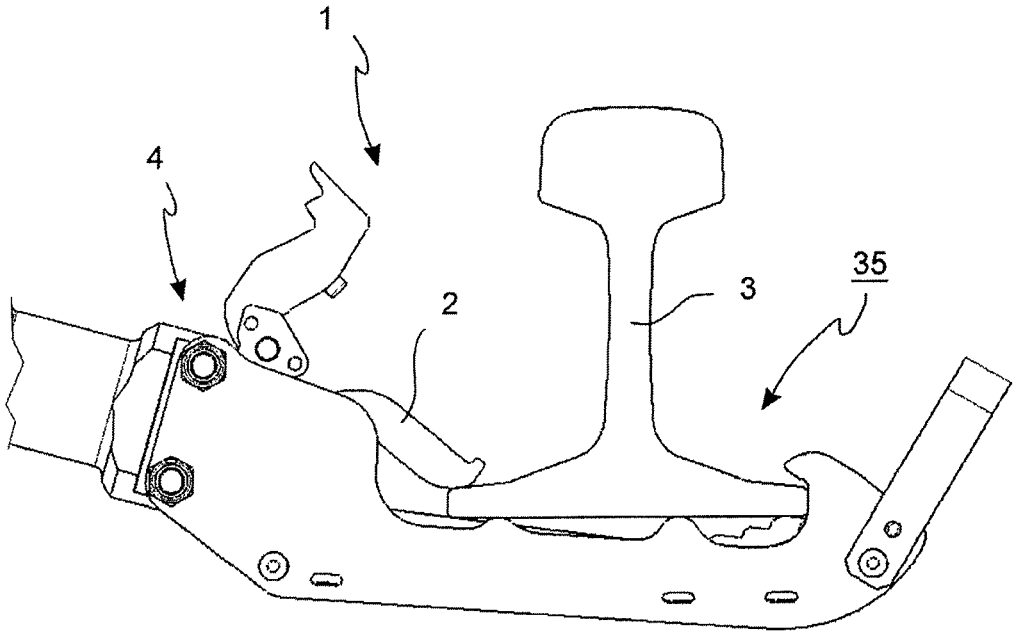
FIG. 4 shows a partial side view of the manual applicator, of the contact clip and the railway rail during a further application step of the contact clip to the foot of the rail.

FIGS. 3 to 6 and FIG. 10 show a sequence of steps of the application of the contact clip 2 to the rail 3. The clip 2 is positioned in the clip seat 19 of the applicator 4 with the first hook-shaped end 5 facing towards the thrust jaw 20 on the thrust side 21 of the clip seat 19. The applicator 4 bearing the clip 2 is then inserted between the rail 3 and the track bed and positioned transversally under the foot 7 of the rail. Such insertion of the applicator 4 under the rail is facilitated thanks to the shape, similar to the blade of an ice-skate, of the side walls 36. Subsequently the front end of the applicator is raised, lowering the handle 25 on the opposite side of the rail, and pulled towards the rail so as to couple the contrast jaw 22 to the free rim 6' of the foot of the rail. A raising of the handle 25 makes the applicator 4 rotate around the fulcrum formed by the coupling point between the contrast jaw 22 and the foot of the rail with the clip seat containing the clip 2 facing it. In this position of use the upper rims of the side walls 36 of the applicator rest underneath against the foot of the rail and the coupling seat of the clip finds itself at least partially outside the clip seat and facing or partially inserted on the free rim 6 of the foot of the rail opposite that engaged by the contrast jaw (FIGS. 4 and 5). By operating the thrust device 24, for example by means of the pump lever 28, the thrust jaw 20 which engages the clip with its first thrust surface 31 moves towards the contrast side and pushes the clip 2 to engage with the foot of the rail (FIG. 6). By operating the release button 43 of the thrust device, the thrust jaw returns (for example thanks to a return spring) to the retracted position and it is possible to detach and remove the applicator from the clip and from the rail.

FIGS. 7 to 9 and FIG. 11 show steps of a removal operation of the contact clip from the rail. In this case, the applicator 4 is inserted with the empty clip seat between a portion of rail fitted with the clip and the track bed so as to receive the clip in the clip seat with the second end facing towards the thrust jaw 20. In this case too the insertion of the applicator 4 under the rail is facilitated by the shape of the side walls similar to that of the blade of an ice skate. Subsequently the front end of the applicator is raised, lowering the handle 25 onto the opposite side of the rail, and pulled towards the rail so as to couple the contrast jaw 22 to the free rim 6 of the foot of the rail (on the side of the hook-shaped end of the clip). A raising of the handle 25 makes the applicator 4 rotate around the fulcrum formed by the coupling point between the contrast jaw 22 and the foot of the rail and positions the clip seat and the thrust jaw 20 in relation to the clip 2 (FIG. 8). The adaptor block 32 is now moved into the working position in front of the thrust portion 30 to adapt the thrust jaw 20 to the shape and position of the second end 8 of the clip 2 and to shorten the stroke of the thrust jaw 20. By operating the thrust device 24, for example by means of the pump lever 28, the thrust jaw 20 which engages the clip with its second thrust surface 33 moves towards the contrast side and removes the clip 2 from the foot of the rail (FIG. 9). By operating the release button 43 of the thrust device 24, the thrust jaw returns (for example thanks to a return spring) to the retracted position and it is possible to remove the applicator from the rail.

Of course, a person skilled in the art may make further modifications and variants to the applicator and to the contact clip according to the present invention so as to satisfy contingent and specific requirements, all moreover contained within the scope of protection of the invention, as defined by the following claims.

What is claimed is:

1. Applicator for removing and fixing a contact clip to a train rail, wherein the contact clip forms a first hook-shaped end suitable for being forced onto a foot of the rail, and a second end with an abutment surface facing towards the first end and suitable for abutting against the foot of the rail on a side opposite the first end, wherein the applicator comprises:

an applicator body forming a clip seat suitable for receiving the contact clip, a thrusting jaw connected with the applicator body and arranged on a thrusting side of the clip seat, said thrusting jaw being suitable for engaging the contact clip received in the clip seat, a contrast jaw connected with the applicator body and arranged on a contrast side of the clip seat opposite the thrusting side, said contrast jaw being suitable for engaging the foot of the rail, a thrusting device connected to the applicator body and suitable for moving the thrusting jaw relative to and towards the contrast jaw so as to thrust the contact clip received in the clip seat in a thrusting direction towards the contrast side, wherein the applicator can be positioned in a use position at the rail in which the clip seat facing the foot of the rail receives the contact clip and the contrast jaw engages the foot of the rail on a first side of the rail whereas the thrusting jaw engages an end of the contact clip on a second side of the rail opposite the first side, wherein, in said use position, the movement of the thrusting jaw relative to and towards the contrast jaw moves the contact clip relative to the contrast jaw and relative to the foot of the rail so as to connect or disconnect the contact clip and the foot of the rail to/from one another, wherein the clip seat is suitable for supporting the contact clip transversally to the thrusting direction in an area between the thrusting jaw and the contrast jaw, and wherein the applicator body comprises two side walls that are substantially parallel and connected together through one or more bridge elements, the side walls having inner surfaces facing one another that laterally define the clip seat, and upper edges facing towards an upper side of the applicator and defining a support seat for the foot of the rail, in which the contrast jaw is formed directly by said side walls.

2. Applicator according to claim 1, wherein the thrusting device comprises an oil-hydraulic cylinder-piston group with a pump that can be manually actuated through a pumping lever.

3. Applicator according to claim 2, wherein the pumping lever is able to rotate about a longitudinal axis of the applicator body.

4. Applicator according to claim 1, wherein the thrusting jaw is able to move with respect to the clip seat so as to move the contact clip received in the clip seat with respect to the clip seat.

5. Applicator according to claim 1, wherein the thrusting jaw is able to move together with the clip seat with respect to the contrast jaw.

6. Applicator according to claim 1, wherein the clip seat is suitable for receiving the contact clip:

in an application position in which the thrusting jaw engages the first hook-shaped end, and in a removal position in which the thrusting jaw engages the second end.

7. Applicator according to claim 1, wherein the contrast jaw has a hook shape defining a cavity facing towards the thrusting side of the clip seat and suitable for receiving a free edge of the foot of the rail and for engaging said free edge from above and from the side.

8. Applicator according to claim 1, wherein the upper edges form two local projections that, together with the contrast jaw, determine a positioning reference of the rail with respect to the clip seat.

9. Applicator according to claim 1, wherein the clip seat has one or more elastically yielding bottom walls suitable for elastically biasing the contact clip against the foot of the rail when the applicator is in the use position.

10. Applicator according to claim 9, wherein the bottom walls comprise two elastic walls that are separate and independently deformable with respect to one another, the first elastic wall of which forms a first substantially flat support surface and the second elastic wall of which forms a second substantially flat support surface that is inclined with respect to the first support surface.

11. Applicator according to claim 1, comprising an elastic abutment formed on the contrast side of the clip seat and opposite the thrusting jaw so as to be able to hold the clip received in the clip seat elastically between the thrusting jaw and the elastic abutment.

12. Applicator according to claim 9, wherein an elastic abutment is formed from a projection of one of the elastically yielding bottom walls, said elastic abutment being formed on the contrast side of the clip seat and opposite the thrusting jaw so as to be able to hold the clip received in the clip seat elastically between the thrusting jaw and the elastic abutment.

13. Applicator according to claim 1, having one or more skate blade-shaped edges so as to facilitate the insertion of the applicator between the rail and a track ballast.

14. Applicator according to claim 1, comprising an anti-expulsion bracket connected to the applicator body and able to be positioned on the contrast side of the clip seat in an expulsion path of the contact clip so as to obstruct the complete expulsion of the clip out from the clip seat.

15. Applicator according to claim 1, wherein the thrusting device comprises an electromechanical jack or a mechanical jack.

16. Applicator for removing and fixing a contact clip to a train rail, wherein the contact clip forms a first hook-shaped end suitable for being forced onto a foot of the rail, and a second end with an abutment surface facing towards the first end and suitable for abutting against the foot of the rail on a side opposite the first end, wherein the applicator comprises:

an applicator body forming a clip seat suitable for receiving the contact clip, a thrusting jaw connected with the applicator body and arranged on a thrusting side of the clip seat, said thrusting jaw being suitable for engaging the contact clip received in the clip seat, a contrast jaw connected with the applicator body and arranged on a contrast side of the clip seat opposite the thrusting side, said contrast jaw being suitable for engaging the foot of the rail, a thrusting device connected to the applicator body and suitable for moving the thrusting jaw relative to and towards the contrast jaw so as to thrust the contact clip received in the clip seat in a thrusting direction towards the contrast side, wherein the applicator can be positioned in a use position at the rail in which the clip seat facing the foot of the rail receives the contact clip and the contrast jaw engages the foot of the rail on a first side of the rail whereas the thrusting jaw engages an end of the contact clip on a second side of the rail opposite the first side, wherein, in said use position, the movement of the thrusting jaw relative to and towards the contrast jaw moves the contact clip relative to the contrast jaw and relative to the foot of the rail so as to connect or disconnect the contact clip and the foot of the rail to/from one another, wherein the clip seat is suitable for supporting the contact clip transversally to the thrusting direction in an area between the thrusting jaw and the contrast jaw, wherein the thrusting jaw comprises a thrusting portion forming a first thrusting surface for engaging the first end of the contact clip, as well as an adapter block forming a second thrusting surface for engaging the second end of the contact clip, in which the adapter block is connected to the thrusting portion so as to be able to move between a work position overlapping the first thrusting surface and a rest position away from the first thrusting surface.

17. System for removing and fixing a contact clip to a train rail, comprising a contact clip having a first hook-shaped end suitable for being forced onto a foot of the rail, and a second end with an abutment surface facing towards the first end and suitable for abutting against the foot of the rail on a side opposite the first end, the system further comprising an applicator for removing and fixing said contact clip to a train rail, said applicator comprising:

an applicator body forming a clip seat suitable for receiving the contact clip, a thrusting jaw connected with the applicator body and arranged on a thrusting side of the clip seat, said thrusting jaw being suitable for engaging the contact clip received in the clip seat, a contrast jaw connected with the applicator body and arranged on a contrast side of the clip seat opposite the thrusting side, said contrast jaw being suitable for engaging the foot of the rail, a thrusting device connected to the applicator body and suitable for moving the thrusting jaw relative to and towards the contrast jaw so as to thrust the contact clip received in the clip seat in a thrusting direction towards the contrast side, wherein the applicator can be positioned in a use position at the rail in which the clip seat facing the foot of the rail receives the contact clip and the contrast jaw engages the foot of the rail on a first side of the rail whereas the thrusting jaw engages an end of the contact clip on a second side of the rail opposite the first side, wherein, in said use position, the movement of the thrusting jaw relative to and towards the contrast jaw moves the contact clip relative to the contact contrast jaw and relative to the foot of the rail so as to connect or disconnect the contact clip and the foot of the rail to/from one another, wherein the clip seat is suitable for supporting the contact clip transversally to the thrusting direction in an area between the thrusting jaw and the contrast jaw, wherein the clip seat of the applicator is configured so that, when the contact clip is received in the clip seat, the first hook-shaped end of the clip extends out from the clip seat so as to be able to receive a free edge of a foot of the rail, and wherein the applicator body comprises two side walls that are substantially parallel and connected together through one or more bridge elements, the side walls having inner surfaces facing one another that laterally define the clip seat, and upper edges facing towards an upper side of the applicator and defining a support seat for the foot of the rail, in which the contrast jaw is formed directly by said side walls.

18. Applicator for removing and fixing a contact clip to a train rail, wherein the contact clip forms a first hook-shaped end suitable for being forced onto a foot of the rail, and a second end with an abutment surface facing towards the first end and suitable for abutting against the foot of the rail on a side opposite the first end, wherein the applicator comprises:

an applicator body forming a clip seat suitable for receiving the contact clip, a thrusting jaw connected with the applicator body and arranged on a thrusting side of the clip seat, said thrusting jaw being suitable for engaging the contact clip received in the clip seat, a contrast jaw connected with the applicator body and arranged on a contrast side of the clip seat opposite the thrusting side, said contrast jaw being suitable for engaging the foot of the rail, a thrusting device connected to the applicator body and suitable for moving the thrusting jaw relative to and towards the contrast jaw so as to thrust the contact clip received in the clip seat in a thrusting direction towards the contrast side, wherein the applicator can be positioned in a use position at the rail in which the clip seat facing the foot of the rail receives the contact clip and the contrast jaw engages the foot of the rail on a first side of the rail whereas the thrusting jaw engages an end of the contact clip on a second side of the rail opposite the first side, wherein, in said use position, the movement of the thrusting jaw relative to and towards the contrast jaw moves the contact clip relative to the contrast jaw and relative to the foot of the rail so as to connect or disconnect the contact clip and the foot of the rail to/from one another, wherein the clip seat is suitable for supporting the contact clip transversally to the thrusting direction in an area between the thrusting jaw and the contrast jaw, wherein first and second resilient spring members for biasing the contact clip against the foot of the rail when the applicator is in the use position are separately located on the clip seat, said first and second spring members being deformable independently of one another, the first spring member forming a substantially flat support surface and the second spring member forming a second substantially flat support surface that is inclined with respect to the first support surface.

19. A method for removing and fixing a contact clip to a train rail, comprising:

providing a contact clip having a first hook-shaped end suitable for being forced onto a foot of the rail, and a second end with an abutment surface facing towards the first end and suitable for abutting against the foot of the rail on a side opposite the first end, providing an applicator for removing and fixing said contact clip to a train rail, said applicator comprising:

an applicator body forming a clip seat suitable for receiving the contact clip, a thrusting jaw connected with the applicator body and arranged on a thrusting side of the clip seat, said thrusting jaw being suitable for engaging the contact clip received in the clip seat, a contrast jaw connected with the applicator body and arranged on a contrast side of the clip seat opposite the thrusting side, said contrast jaw being suitable for engaging the foot of the rail, a thrusting device connected to the applicator body and suitable for moving the thrusting jaw relative to and towards the contrast jaw so as to thrust the contact clip received in the clip seat in a thrusting direction towards the contrast side, wherein the applicator body comprises two side walls that are substantially parallel and connected together through one or more bridge elements, the side walls having inner surfaces facing one another that laterally define the clip seat, and upper edges facing towards an upper side of the applicator and defining a support seat for the foot of the rail, in which the contrast jaw is formed directly by said side walls, positioning the applicator in a use position at the rail in which:

the contrast jaw engages the foot of the rail on a first side of the rail and the thrusting jaw engages first hook shaped end of the contact clip on a second side of the rail opposite the first side, and the clip seat faces the foot of the rail and receives the contact clip with the first hook-shaped end extending out from the clip seat and hooking over a free edge of the foot of the rail, with the applicator in said use position, using the thrusting device for moving the thrusting jaw relative to and towards the contrast jaw so that the contact clip is moved relative to the contrast jaw and relative to the foot of the rail until the contact clip engages or disengages the foot of the rail, in said use position, during moving the thrusting jaw relative to and towards the contrast jaw, using the clip seat for supporting the contact clip transversally to the thrusting direction in an area between the thrusting jaw and the contrast jaw.

* * * * *